US007726324B2

(12) United States Patent
Choi et al.

(10) Patent No.: US 7,726,324 B2
(45) **Date of Patent: *Jun. 1, 2010**

(54) DISHWASHER

(75) Inventors: Seung Bong Choi, Changwon-si (KR); Sangheon Yoon, Gwangmyeong-si (KR); Nungseo Park, Seoul (KR); Hung Myong Cho, Gyeongsangnam-do (KR); Dae Yeong Han, Seoul (KR); Byung Hwan Ahn, Gimhae-si (KR); Hyeokdeok Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/554,864

(22) PCT Filed: Sep. 15, 2005

(86) PCT No.: PCT/KR2005/003051

§ 371 (c)(1),
(2), (4) Date: Apr. 5, 2007

(87) PCT Pub. No.: WO2006/031064

PCT Pub. Date: Mar. 23, 2006

(65) Prior Publication Data

US 2007/0261725 A1 Nov. 15, 2007

(51) Int. Cl.
*B08B 3/04* (2006.01)

(52) U.S. Cl. ..... 134/104.2

(58) Field of Classification Search ..... 134/104.2
See application file for complete search history.

(56) References Cited

U.S. PATENT DOCUMENTS 4,150,680 A 4/1979 Johnson et al.
4,243,431 A 1/1981 Dingler et al.

(Continued)

FOREIGN PATENT DOCUMENTS

DE 2951837 A1 7/1980

(Continued)

OTHER PUBLICATIONS

Translation of young-man cho korean application 20-1998-0057987.*

(Continued)

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

The present invention relates to a dishwasher. In more detail, the present invention provides a dishwasher including a sump housing for holding washing water, a washing water pumping unit for pumping the washing water, a drain chamber for receiving the washing water pumped thus, a soil chamber for receiving the washing water through the drain chamber, a guide assembly for guiding the washing water pumped thus to be provided to the soil chamber via the drain chamber, and a sump cover covered on an upper surface of the sump housing for filtering the washing water overflowed from the soil chamber, thereby filtering the washing water effectively, and improving recovery ratio of the washing water to reduce consumption of the washing water and power.

30 Claims, 13 Drawing Sheets

U.S. PATENT DOCUMENTS

| | | | | |
|---|---|---|---|---|
| 4,392,891 | A * | 7/1983 | Meyers | 134/10 |
| 4,448,359 | A | 5/1984 | Meyers | |
| 5,377,707 | A | 1/1995 | Young, Jr. | |
| 5,433,232 | A | 7/1995 | Young, Jr. | |
| 5,450,868 | A * | 9/1995 | Young, Jr. | 134/111 |
| 5,601,660 | A * | 2/1997 | Jeon et al. | 134/10 |
| 5,609,172 | A | 3/1997 | Chang et al. | |
| 5,779,812 | A * | 7/1998 | Thies et al. | 134/10 |
| 5,909,743 | A | 6/1999 | Thies et al. | |
| 6,418,943 | B1 | 7/2002 | Miller | |
| RE37,831 | E | 9/2002 | Thies | |
| 7,409,962 | B2 * | 8/2008 | Welch | 134/198 |
| 2003/0205246 | A1 | 11/2003 | Christman et al. | |
| 2004/0103926 | A1 * | 6/2004 | Ha | 134/57 D |
| 2005/0263174 | A1 | 12/2005 | Yoon | |

FOREIGN PATENT DOCUMENTS

| | | | |
|---|---|---|---|
| DE | 4418523 | A1 | 11/1995 |
| GB | 901 476 | | 7/1962 |
| GB | 2 204 482 | A | 11/1988 |
| GB | 2308171 | A | 6/1997 |
| KR | 20-1998-0057987 | | 10/1998 |
| KR | 2019980057987 | * | 10/1998 |
| KR | 20-2000-0003391 | | 2/2000 |
| KR | 10-339370 | | 6/2000 |
| KR | 10-2001-0077128 | A | 8/2001 |
| SU | 1738259 | A1 | 6/1992 |

OTHER PUBLICATIONS

International Search Report from the Austrian Patent Office dated Dec. 12, 2005.

* cited by examiner

[Fig. 1]
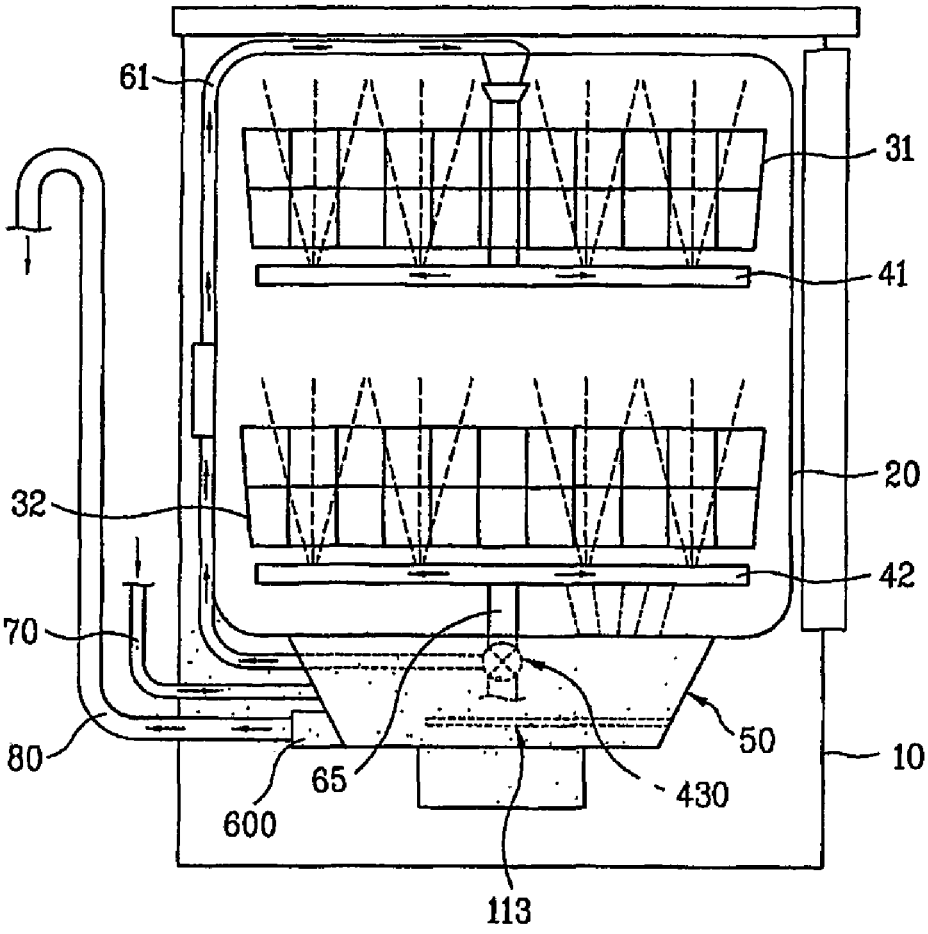

[Fig. 2]
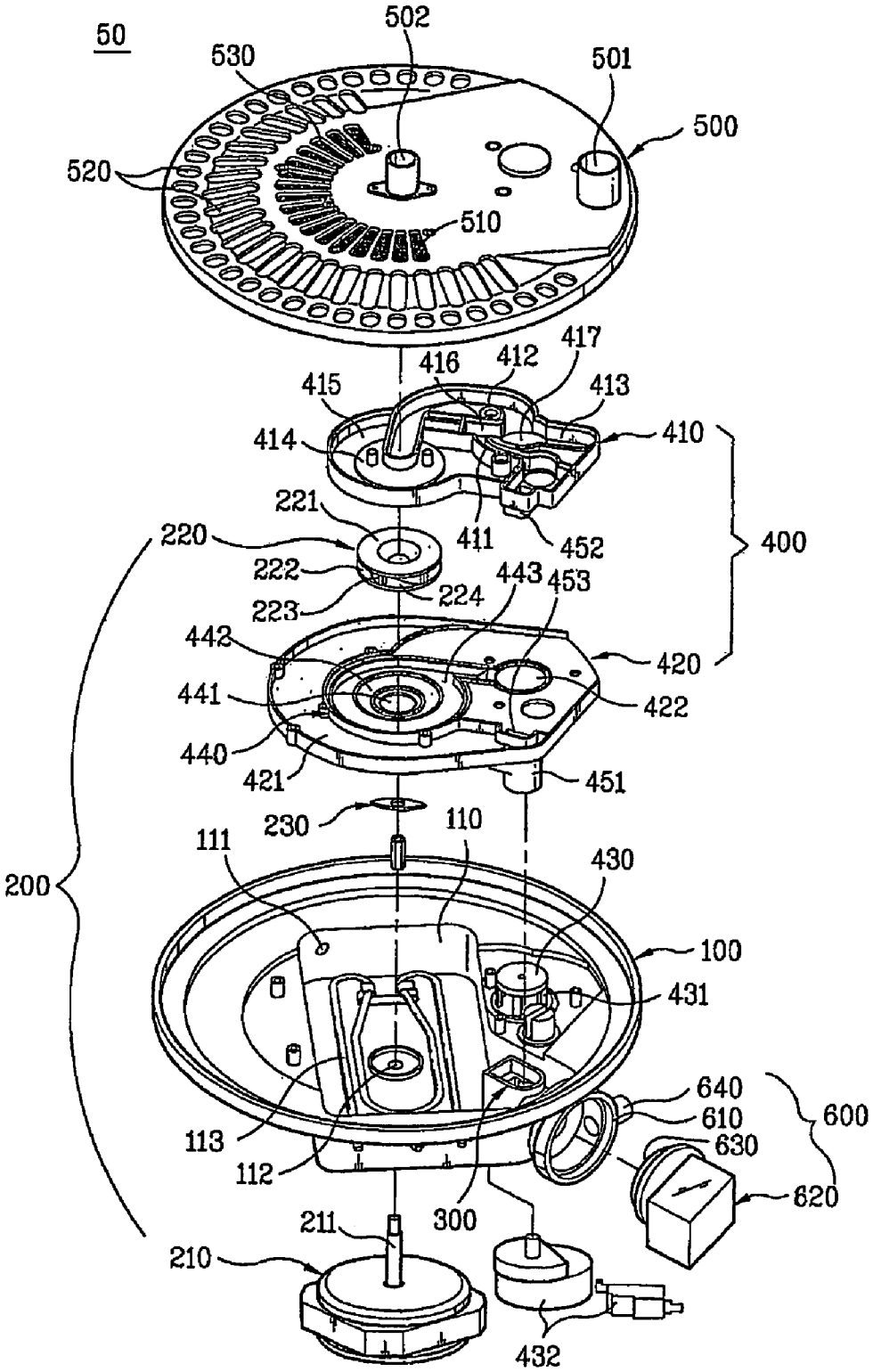

[Fig. 3]
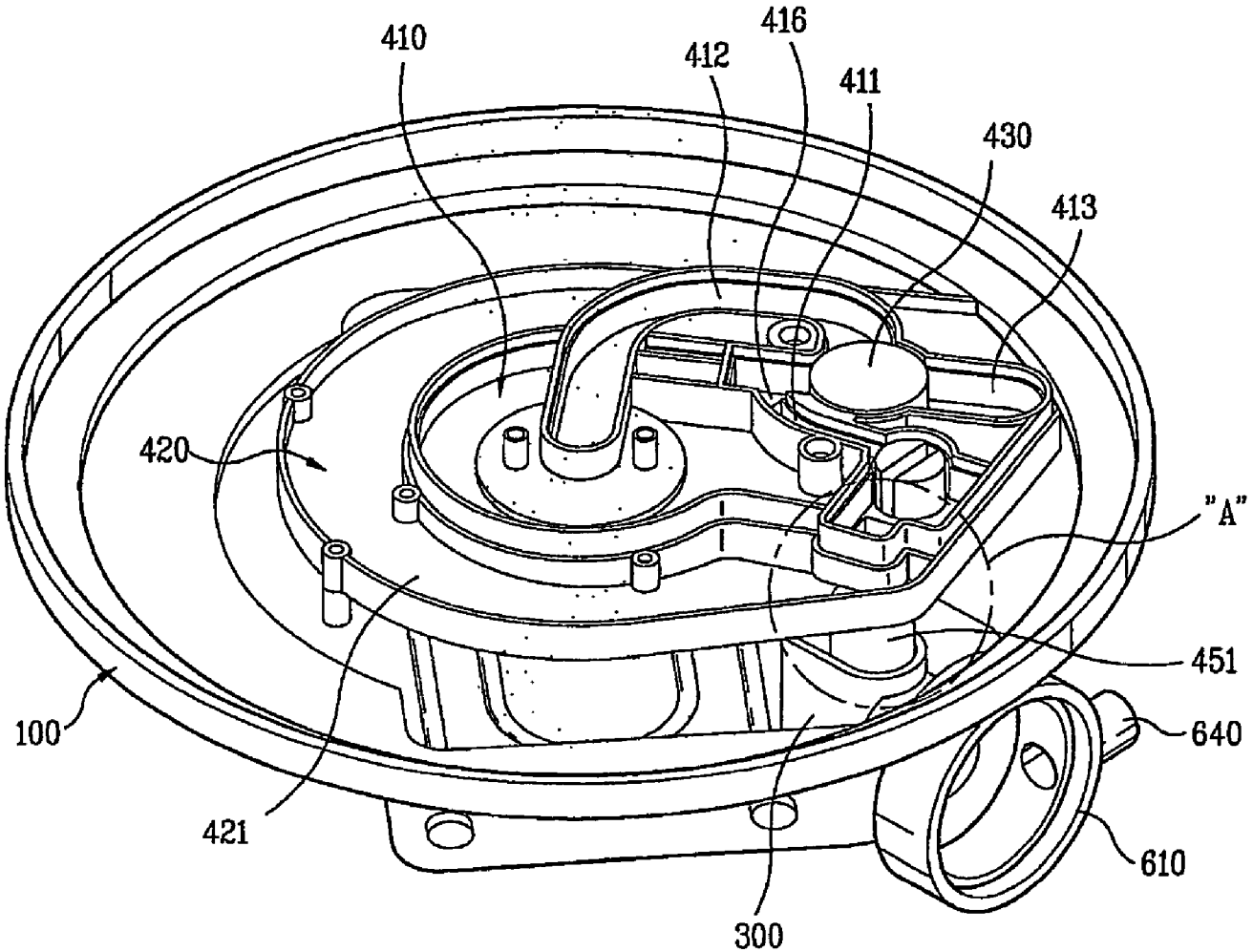

[Fig. 4]
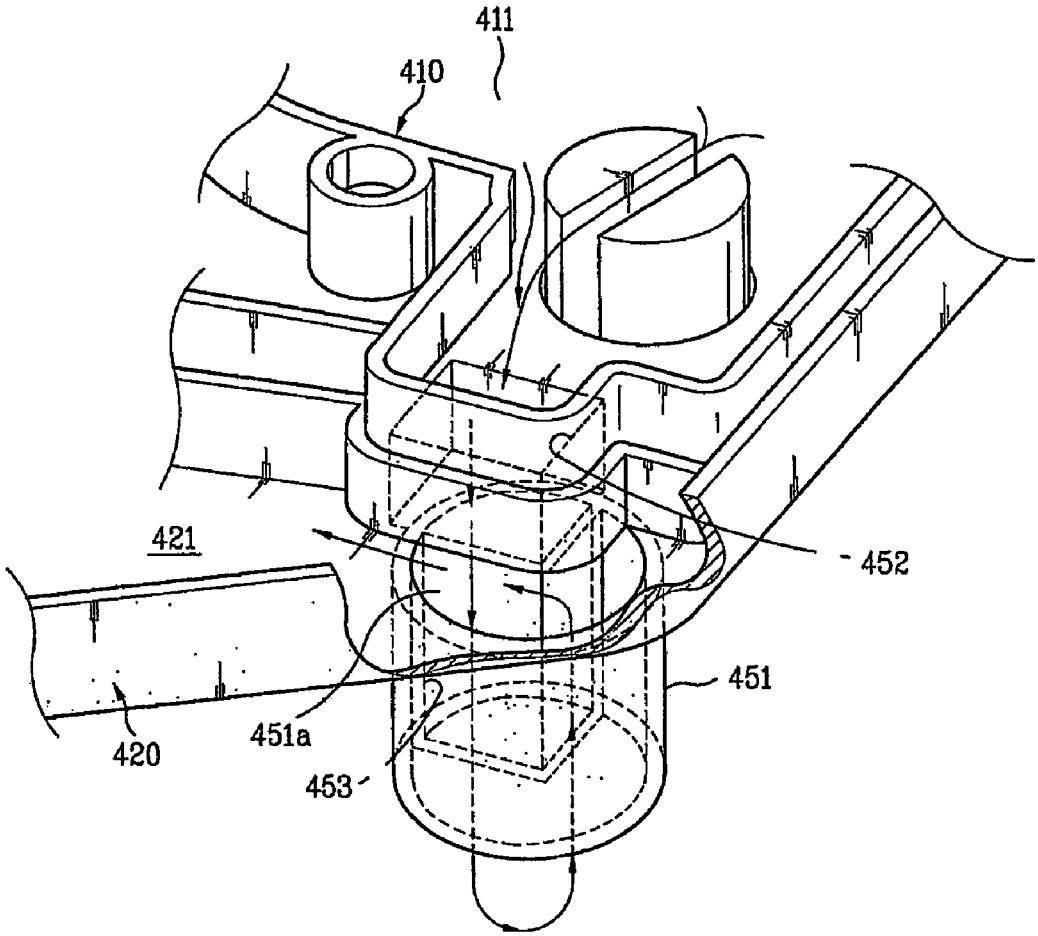
[Fig. 5]
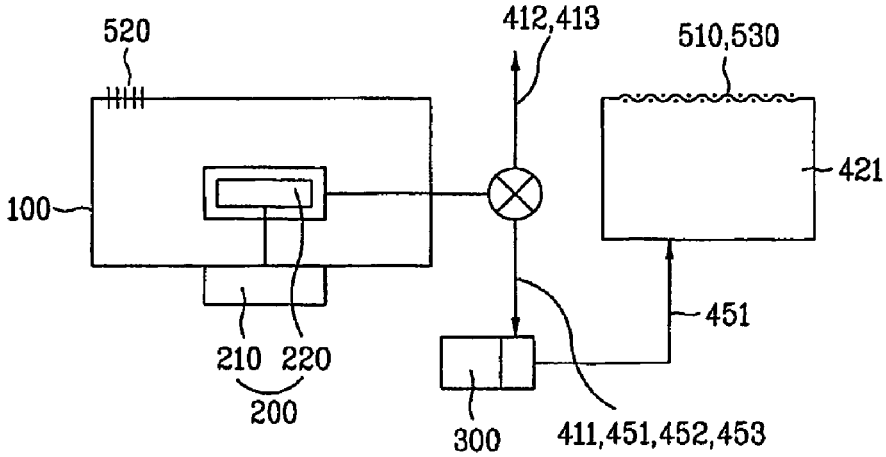

[Fig. 6]
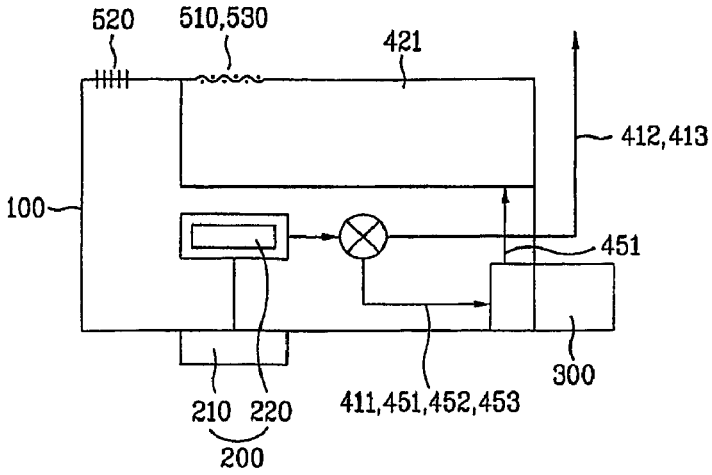
[Fig. 7]
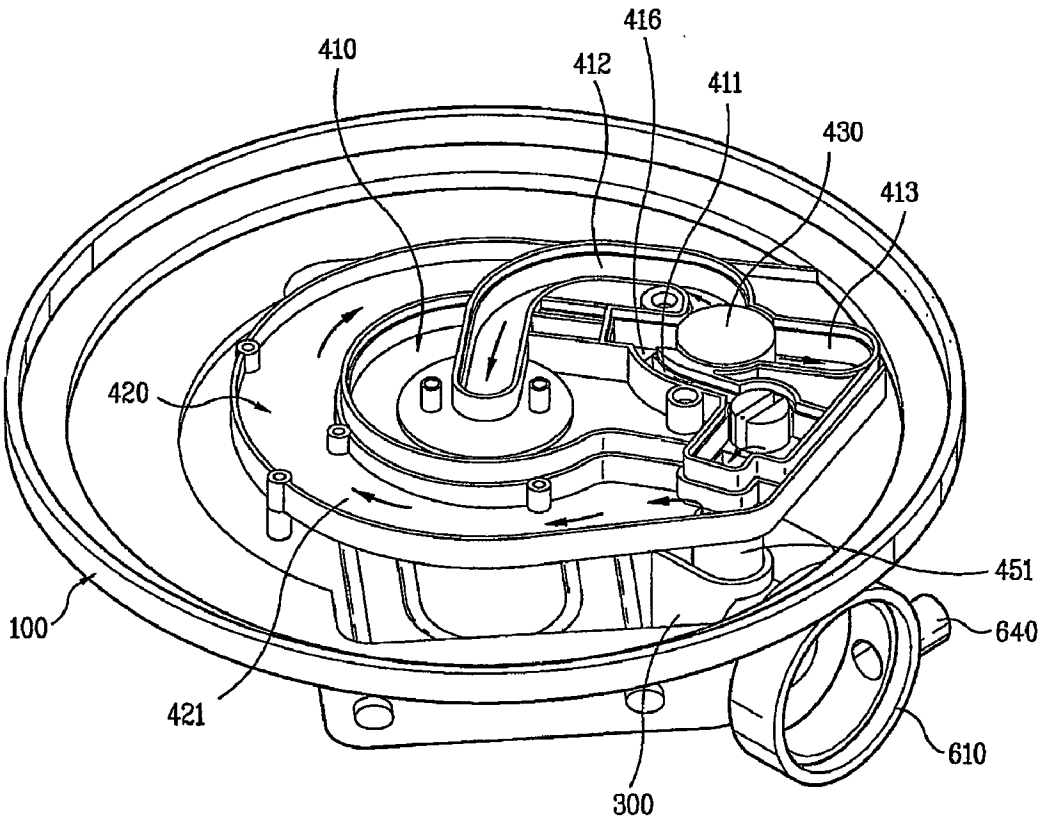

[Fig. 8]
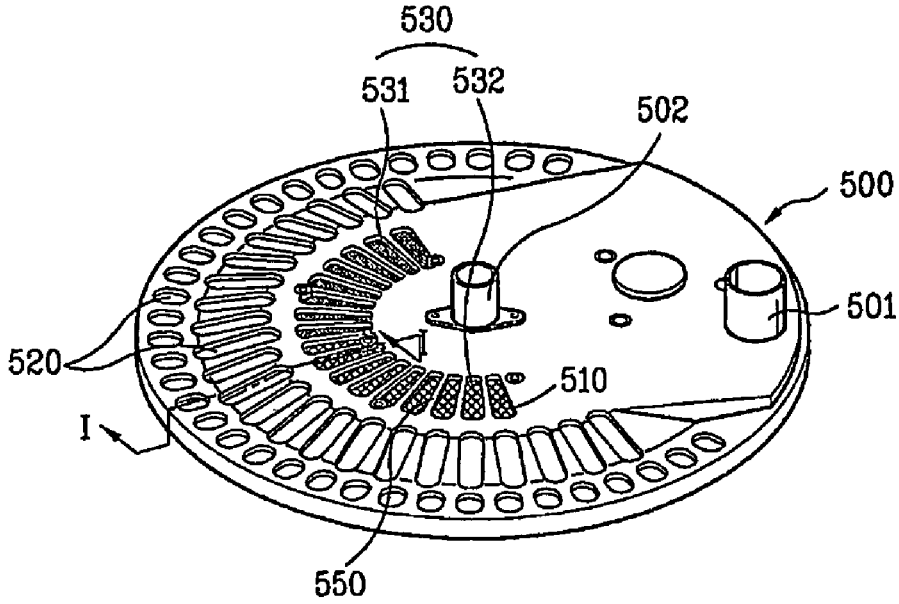
[Fig. 9]
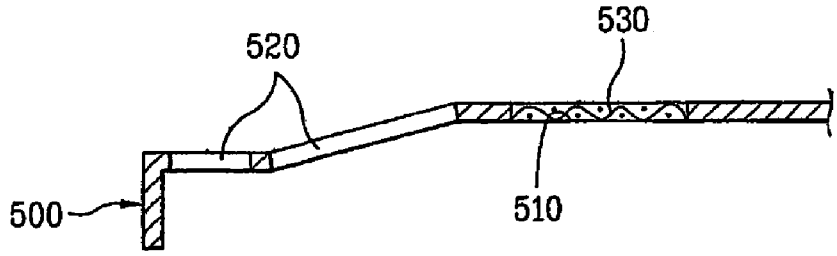

[Fig. 10]
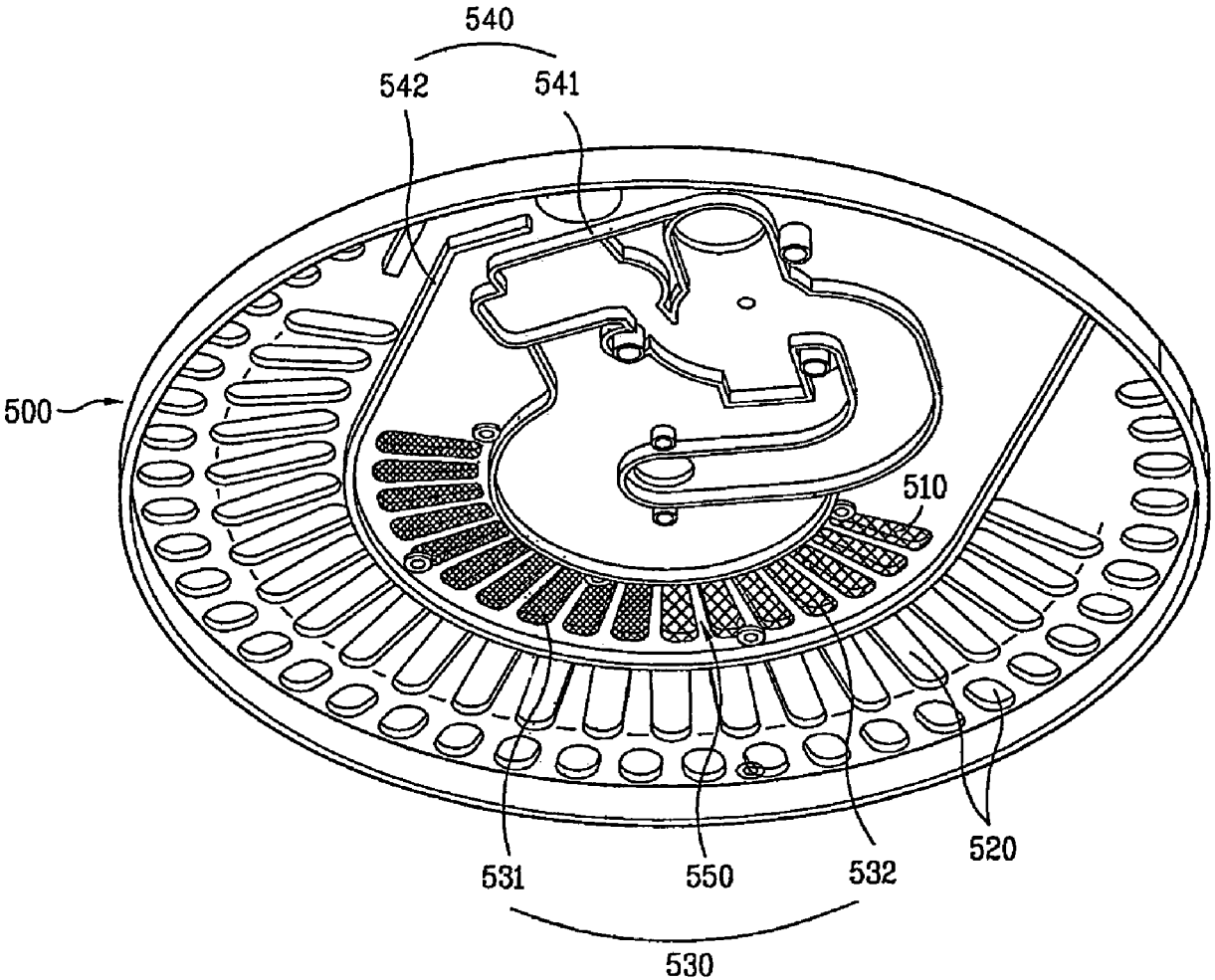

[Fig. 11]
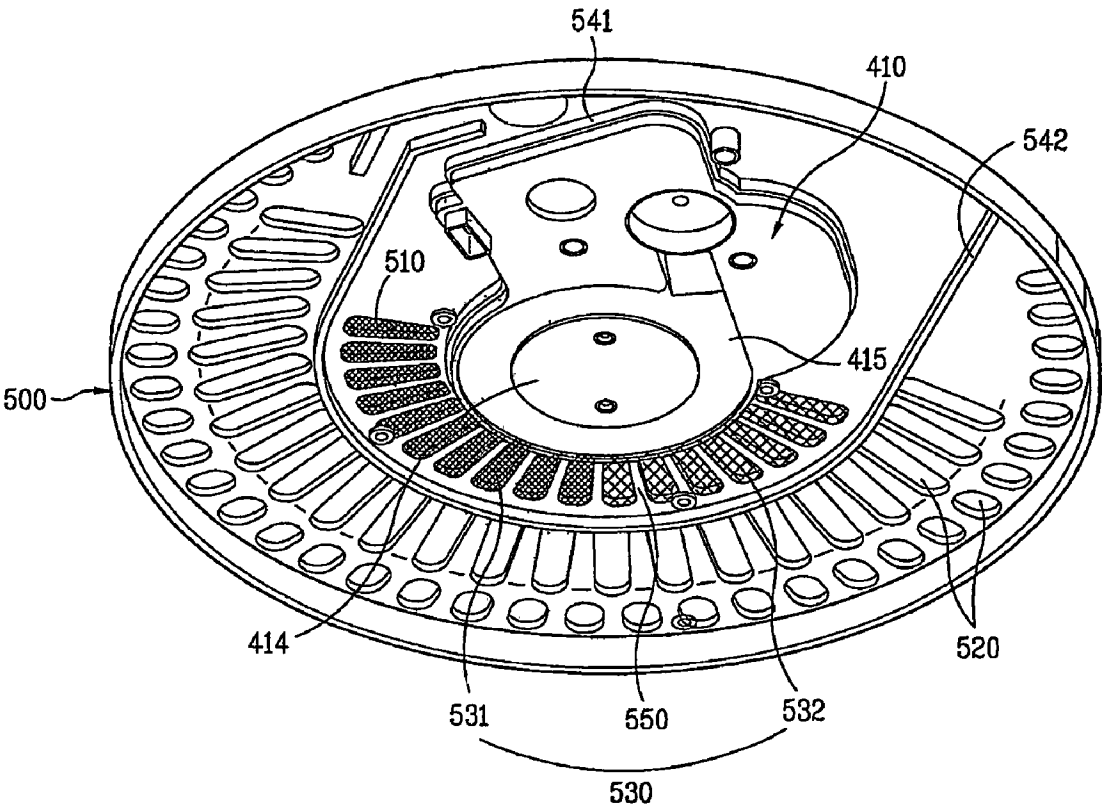
[Fig. 12]
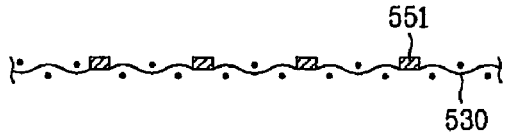
[Fig. 13]
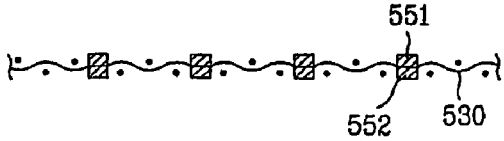

[Fig. 14]
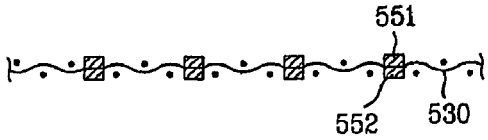
[Fig. 15]
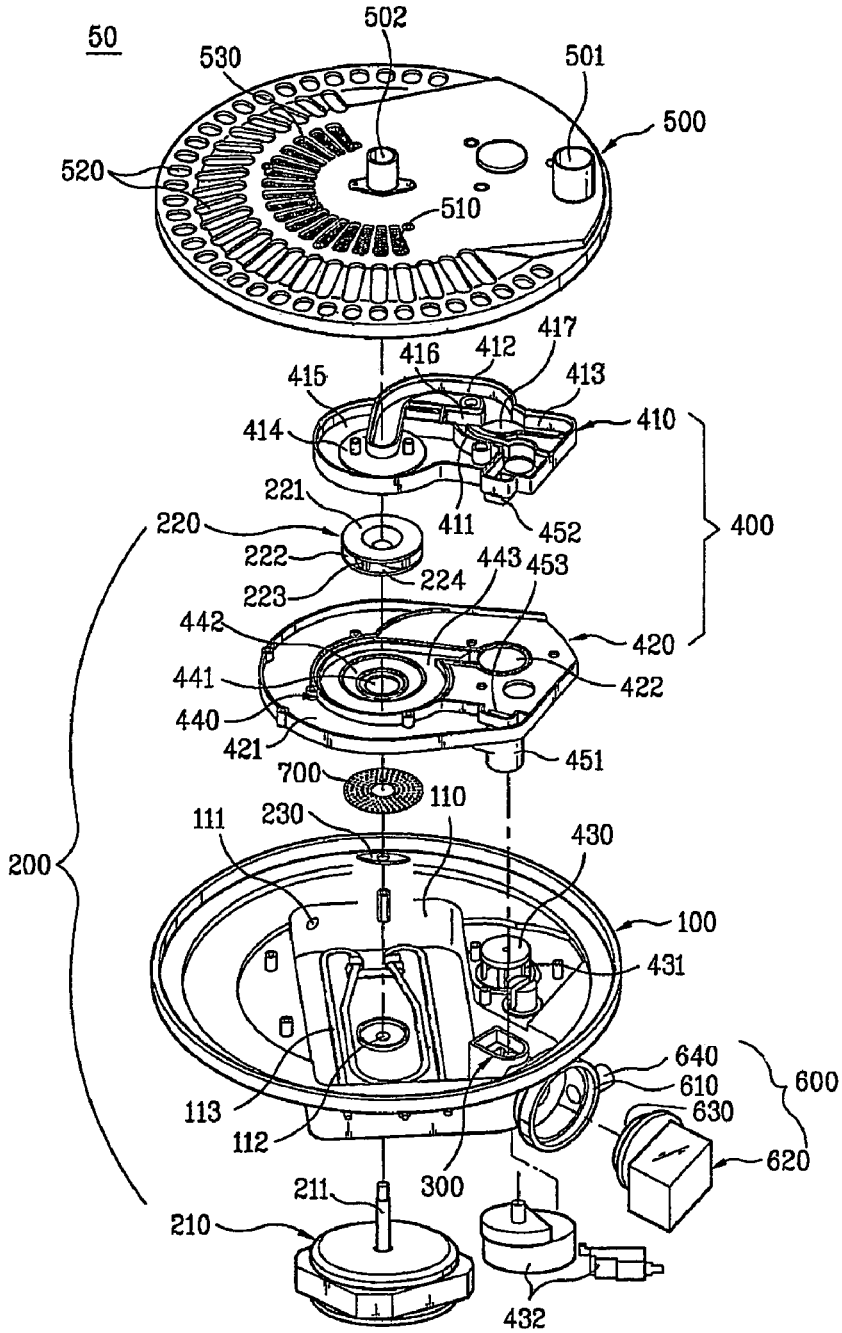

[Fig. 16]
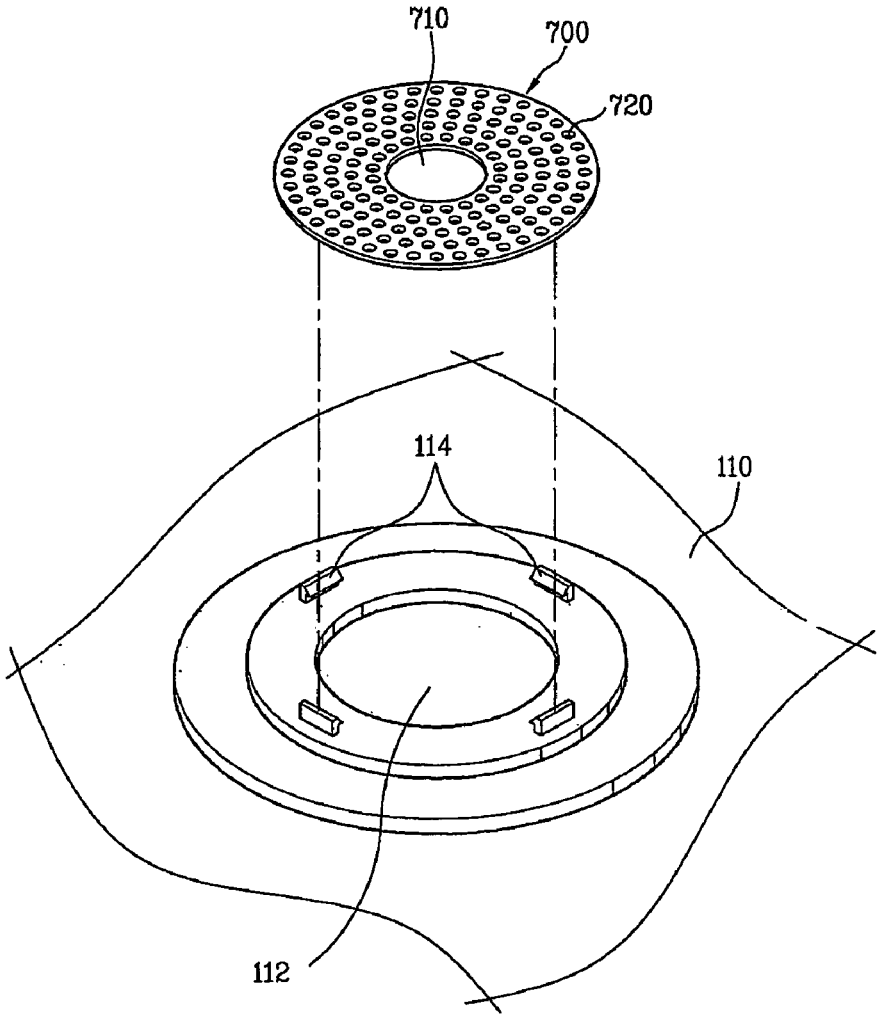
[Fig. 17]
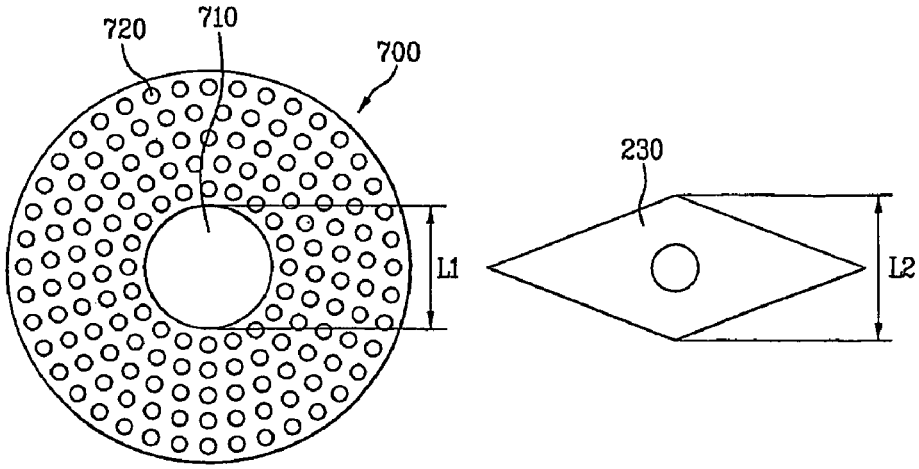

[Fig. 18]
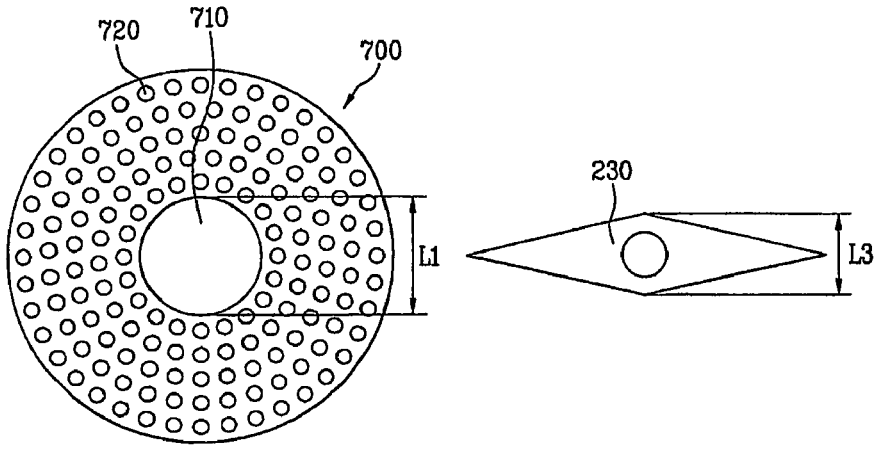
[Fig. 19]
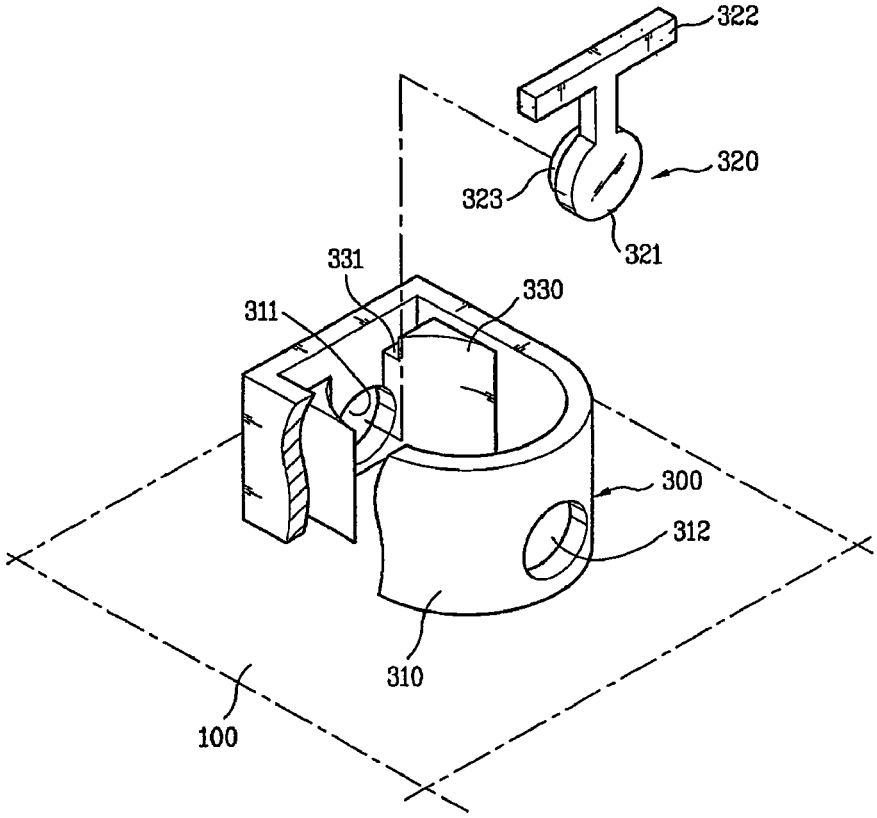

[Fig. 20]
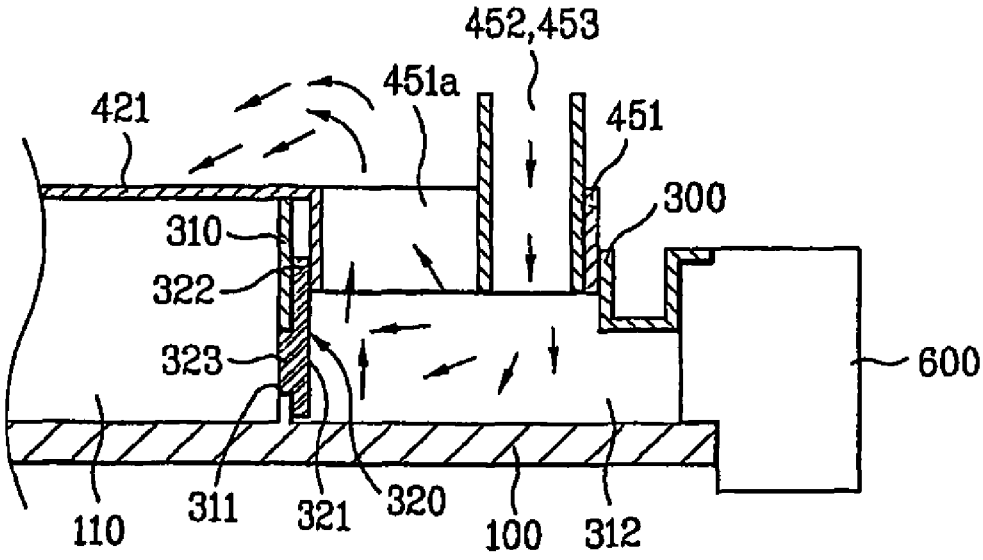
[Fig. 21]
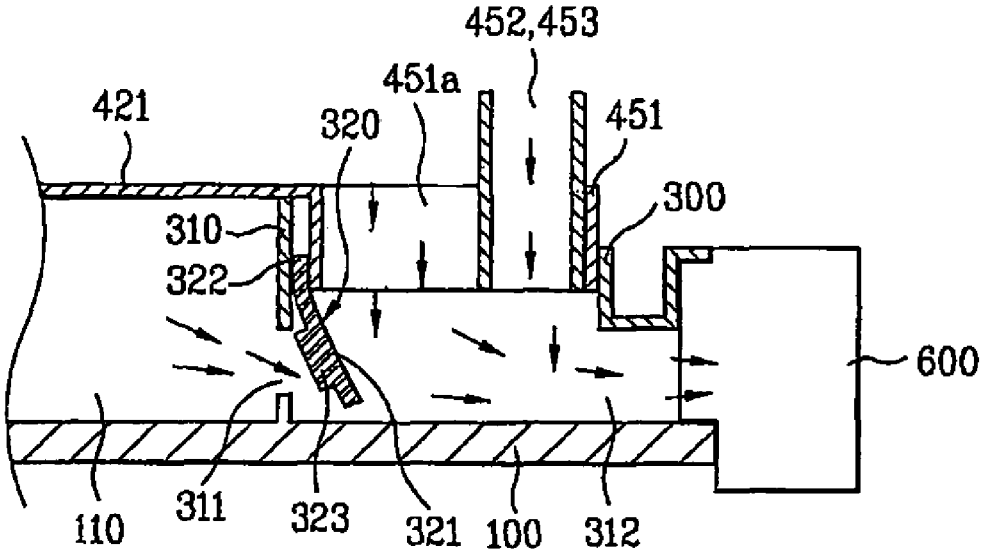

[Fig. 22]
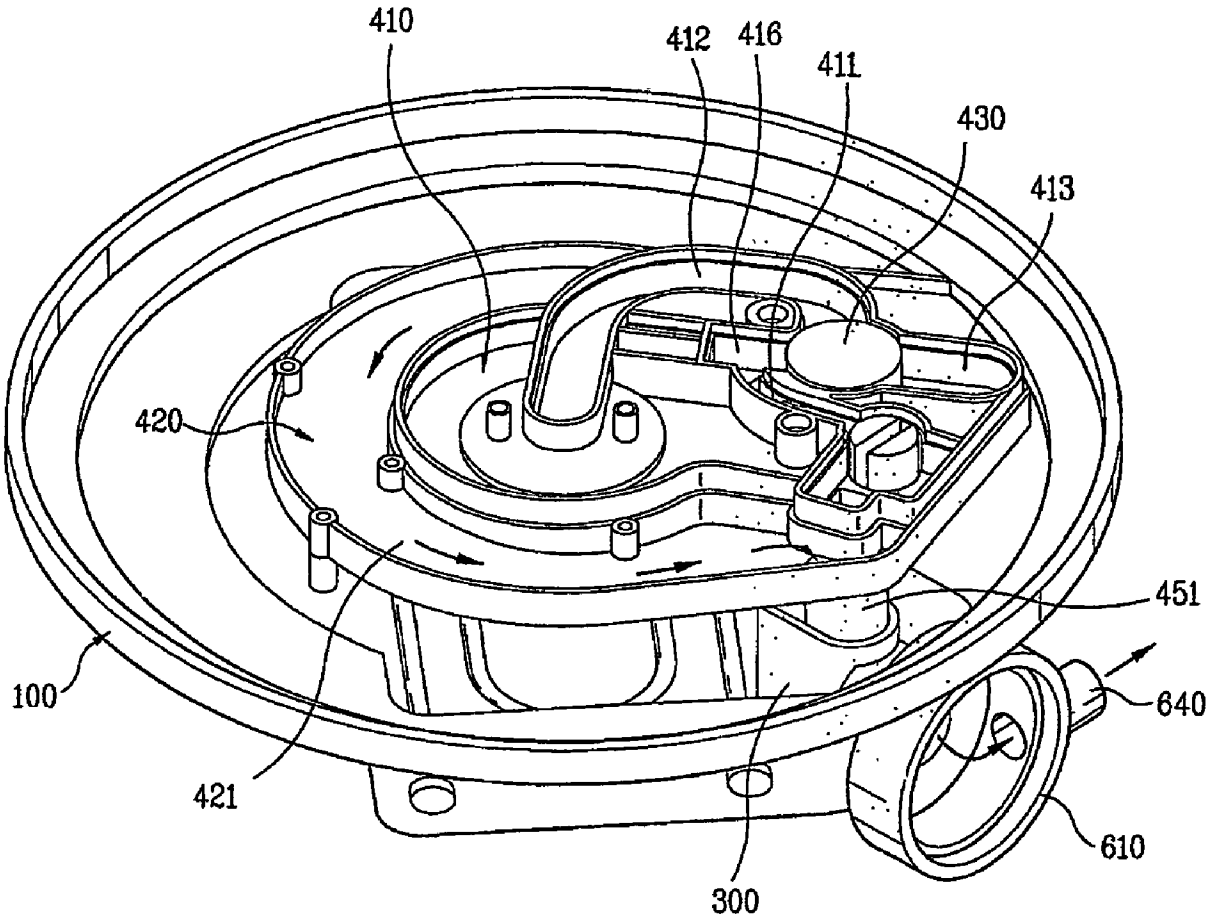

DISHWASHER

This application claims priority to International Application No. PCT/KR2005/003051 filed on Sep. 15, 2005, as well as Korean Applications P 2004-74477 filed Sep. 17, 2004, P 2004-74632 filed Sep. 17, 2004, P 2004-75850 filed Sep. 22, 2004, P 2004-75851 filed Sep. 22, 2004, and P 2004-75929 filed Sep. 22, 2004, all of which are incorporated by reference, as if fully set forth herein.

TECHNICAL FIELD

The present invention relates to dishwashers, and more particularly, to a dishwasher in which washing water is filtered effectively, and recovery ratio of the washing water is improved, to reduce consumption of the washing water and power.

BACKGROUND ART

The dishwasher sprays detergent and washing water to dishes, to wash dishes automatically.

The dishwasher is provided with at least one rack in a tub for placing dishes thereon, a sump for holding washing water, and at least one spray unit for spraying washing water to the dishes.

In the related art dishwasher, the washing water is pumped from the sump to the spray unit, lead to a spray arm along a washing water pipe, and sprayed to the dishes.

The washing water washed the dishes is recovered to the sump, and supplied to the spray unit again for spraying to the dishes.

Such a repetitive use of the washing water leads to increase foreign matters in the washing water, gradually.

According to this, washing performance is impaired, and the foreign matter is liable to block a filter at the sump. If the filter is blocked, an excessive pressure become to exert to the filter, to result in deformation of the filter.

DISCLOSURE

Technical Problem

An object of the present invention is to provide a dishwasher of a new structure which can re-use washing water smoothly, remove foreign matters from the washing water smoothly, and improve washing water recovery efficiency.

Technical Solution

The object of the present invention can be achieved by providing a dishwasher including a sump housing for holding washing water, a washing water pumping unit for pumping the washing water, a drain chamber for receiving the washing water pumped thus, a soil chamber for receiving the washing water through the drain chamber, a guide assembly for guiding the washing water pumped thus to be provided to the soil chamber via the drain chamber, and a sump cover covered on an upper surface of the sump housing for filtering the washing water overflowed from the soil chamber.

The dishwasher includes an upper housing on an upper side of the sump housing, having a sampling flow passage, and a plurality of main flow passages for guiding the washing water not provided to the sampling flow passage to at least one spray arm, and a lower housing under the upper housing, having the soil chamber and the impeller loading portion formed therein.

The dishwasher further includes a connection pipe connected between the soil chamber and the drain chamber, the sampling flow passage has one end inserted in the connection pipe, and the other end connected to an outlet side of the impeller loading portion, and there is a connection flow passage between an inside circumference of the connection pipe and an outside circumferential surface of the one end of the sampling flow passage.

In another aspect of the present invention, a dishwasher includes a sump housing for holding washing water, and a sump cover covered on an upper surface of the sump housing, having a plurality of pass through holes for draining the washing water from the sump housing, and a plurality of recovery holes for recovering the washing water drained thus to the sump housing.

The pass through holes are formed in an inner side of the sump cover, and the recovery holes are formed in an outer portion of the sump cover.

The sump cover has an upper surface sloped downward as it goes from a portion the pass through holes are formed therein to a portion the recovery holes are formed therein the more, and preferably, a filter member is further provided to each of the pass through holes. The filter member includes a first filter and a second filter each having a plurality of eyes of mesh, wherein the second filter has eyes of mesh greater than the same of the first filter.

In another aspect of the present invention, a dishwasher includes a sump housing for holding washing water, a washing water pumping unit having a washing motor and an impeller for pumping the washing water, a drain chamber for receiving the washing water pumped thus, a soil chamber above the drain chamber for receiving the washing water through the drain chamber, and a screen on a shaft of the washing motor for filtering foreign matter from the washing water passing through the screen.

The screen includes a plate having a pass through hole for pass through of the shaft of the washing motor, and a plurality of holes for pass through of the washing water, and preferably the screen is fastened to a bottom of the sump housing with hooks.

In further aspect of the present invention, a dishwasher includes a sump housing for holding washing water, a washing water pumping unit for pumping the washing water, a drain chamber for receiving the washing water pumped thus, the drain chamber having a drain hole in an inside wall in communication with the sump housing, and a valve portion in the drain chamber for selective opening of the drain hole.

Preferably, the valve portion makes the drain chamber to be in communication with the sump housing, or the drain chamber to separate from the sump housing owing to a pressure of the washing water flowing through the drain chamber.

Preferably, the valve portion includes a valve body for opening/closing the drain hole, and a fastening portion for fastening the valve body to the drain chamber. Preferably, the valve body includes a projection for inserting in, and fitting to the drain hole.

ADVANTAGEOUS EFFECTS

The dishwasher of the present invention enables smooth separation of foreign matter from washing water even if the washing water is used repeatedly.

According to this, waste of the washing water is reduced, to permit recycling of the washing water.

Moreover, the dishwasher of the present invention has an improved performance of washing, and the filter member of the sump cover is not liable to clog with the foreign matter.

Furthermore, the dishwasher of the present invention provides relatively small particles of the foreign matter to the soil chamber, to prevent a water pressure rise in the soil chamber, and deformation of the filter member.

DESCRIPTION OF DRAWINGS

FIG. 1 illustrates a diagram of a dishwasher in accordance with a preferred embodiment of the present invention, schematically;

FIG. 2 illustrates an exploded perspective view of a sump assembly in a dishwasher in accordance with a first preferred embodiment of the present invention;

FIG. 3 illustrates a perspective view for explaining relations between a sump housing, an upper housing, and a lower housing in a sump assembly of a dishwasher in accordance with a first preferred embodiment of the present invention;

FIG. 4 illustrates a perspective view of key parts showing the "A" part in FIG. 3 more clearly;

FIGS. 5 and 6 each illustrates a diagram for explaining relations between a sump housing, and a soil chamber in a sump assembly of a dishwasher in accordance with a first preferred embodiment of the present invention, schematically;

FIG. 7 illustrates a perspective view for explaining operation for washing a sump assembly in a dishwasher in accordance with a first preferred embodiment of the present invention;

FIG. 8 illustrates a perspective view of key parts for explaining a sump cover in a sump assembly in a dishwasher in accordance with a second preferred embodiment of the present invention;

FIG. 9 illustrates a section across a line I-I in FIG. 8;

FIG. 10 illustrates a bottom perspective view of the sump cover in FIG. 8;

FIG. 11 illustrates a bottom perspective view for explaining a state an upper housing is mounted on an underside of a sump cover;

FIGS. 12 to 14 each illustrates a section of key parts for explaining a filter supporting portion in a sump assembly of a dishwasher in accordance with a second preferred embodiment of the present invention, schematically;

FIG. 15 illustrates an exploded perspective view for explaining a sump assembly in a dishwasher in accordance with a third preferred embodiment of the present invention;

FIG. 16 illustrates an exploded perspective view for explaining a screen mounting structure in a sump assembly of a dishwasher in accordance with a third preferred embodiment of the present invention;

FIGS. 17 and 18 each illustrates a state diagram for explaining a relation between a screen and a disposer in a sump assembly of a dishwasher in accordance with a third preferred embodiment of the present invention;

FIG. 19 illustrates an exploded perspective view for explaining a drain chamber structure in a sump assembly of a dishwasher in accordance with a fourth preferred embodiment of the present invention;

FIGS. 20 and 21 each illustrates a section for explaining an inside structure of a drain chamber in a sump assembly of a dishwasher in accordance with a fourth preferred embodiment of the present invention; and FIG. 22 illustrates a perspective view for explaining a state of draining washing water and foreign matter from a soil chamber during draining.

BEST MODE

Preferred embodiments of the present invention will be described with reference to the attached drawings.

A dishwasher in accordance with a first preferred embodiment of the present invention suggests circulation of washing water and a series of flow passage structures for removing foreign matters from washing water in a circulating process.

That is, the dishwasher in accordance with a first preferred embodiment of the present invention provides a portion of pumped washing water to a soil chamber via a drain chamber for filtering the foreign matter from the washing water, which will be described in more detail.

FIG. 1 illustrates a diagram of a dishwasher in accordance with a preferred embodiment of the present invention, schematically.

That is, the dishwasher in accordance with a preferred embodiment of the present invention includes a body 10, a tub 20, upper/lower spray arms 41, and 42, upper/lower racks 31, and 32, and a sump assembly 50.

The body 10 forms an exterior of the dishwasher.

The tub 20 is in the body 10, and forms a washing space for washing dishes.

The upper spray arm 41 and the lower spray arm 42 are provided for spraying washing water to the dishes on the upper/lower racks 31, and 32. the upper spray arm 41 is provided to an upper space of the tub, and the lower spray arm 41 is provided to a lower space of the tub 20.

The dishes are placed on the upper rack 31 and the lower rack 32. The upper rack 31 is provided to an upper side of the upper spray arm 41 in the upper space of the tub 20, and the lower rack 32 is provided to an upper side of the lower spray arm 42 in the lower space of the tub 20.

The sump assembly 50 receives washing water from an outside of the dishwasher through a water supply pipe 70, and holds the washing water therein, and supplies to the spray arms 41, and 42 selectively or at the same time through a first connection pipe 61 and a second connection pipe 65.

FIG. 2 illustrates a detailed structure of the sump assembly.

The sump assembly 50 will be described in more detail with reference to FIG. 2.

The sump assembly 50 includes a sump housing 100 for holding washing water, a washing pump unit 200 for pumping washing water from the sump housing 100, a drain chamber 300 for providing a portion of pumped washing water, a soil chamber 421 for receiving the washing water via the drain chamber 300, a guide assembly 400 for guiding the pumped washing water to the soil chamber 421 via the drain chamber 300, and a sump cover 500 for filtering the washing water overflowed from the soil chamber 421.

The sump housing 100 of the sump assembly will be described.

The sump housing 100 is under the tub 20, and includes a recess 110 at a center of a bottom for holding the washing water, having a water supply hole 111 in one side for connection of the water supply pipe 70 thereto.

Next, the washing pump unit 200 of the sump assembly will be described.

The washing pump unit 200 includes a washing motor 210 secured to an underside of the sump housing 100, and an impeller 220 coupled to the washing motor 210 with a shaft 211.

Referring to FIG. 2, the shaft 211 of the washing motor 210 passes through a hole 112 in a bottom of the recess 110. There is a disposer 230 mounted on the shaft 211 of the washing motor 210, for smashing foreign matter in the washing water in the recess as the disposer is rotated when the washing motor 210 is operated.

The impeller 220 draws washing water in an axial direction, and discharges the washing water in a radial direction. For this, the impeller 220 includes an upper plate 221 and a lower plate 222 spaced from each other, and a plurality of curved blades 223 between the upper plate 221 and the lower plate 222.

The upper plate 221 has no opening, and the lower plate 222 has an inlet (not shown) at a center for receiving the washing water. The upper plate 221 has a hub (not shown) at a center for placing the shaft 211 of the washing motor 210 at a lower end of the hub. Between adjacent blades 223 of the plurality of curved blades 223, the washing water introduced to the impeller 220 through the inlet flows out.

The drain chamber 300 of the sump assembly 300 will be described.

Referring to FIG. 2, the drain chamber 300 is formed on one side of a bottom of the sump housing 100. The drain chamber 300 and the recess 110 in the sump housing 100 are formed side by side.

At one side of the sump housing 100, which is a side of the drain chamber 300, a drain pump 600 is mounted. The drain pump 600 discharges washing water from the recess 110 and the drain chamber 300 to an outside of the dishwasher.

The drain pump 600 includes an impeller housing 610, a drain motor 620, and an impeller 630. The impeller housing may be formed as one body with the sump housing 100. There is a nipple 640 at a side of the impeller housing 610 for connection of a drain hose 80 thereto. The drain motor 620 is coupled to the impeller 630 with a shaft, and the drain motor 620 is mounted to the impeller housing 610.

Next, the soil chamber 421 in the sump assembly will be described.

The soil chamber 421 receives washing water via the drain chamber 300 for holding foreign matter filtered from the washing water.

It is preferable that the soil chamber 421 is sloped downwardly gradually as it goes toward a portion in communication with the drain chamber 300 the more, for smooth drain of the foreign matter from the soil chamber via the drain chamber 300 and the drain pump 600.

Next, the guide assembly 400 of the sump assembly will be described.

The guide assembly 400 includes an upper housing 410 and a lower housing 420, for providing the washing water pumped by the washing pump unit 200 to the soil chamber 421 via the drain chamber 300.

Referring to FIG. 2, the upper housing 410 is provided to an upper space of the sump housing 100, and the lower housing 420 is provided under the upper housing 100.

In an upper surface of the upper housing 410, there are a sampling flow passage 411, and main flow passages 412, and 413.

The sampling flow passage 411 guides the washing water pumped by the washing pump unit 200 to the drain chamber 300.

The main flow passages 412, and 413 guide the washing water not provided to the sampling flow passage 411 to the upper spray arm 41, or the lower spray arm 42, or both of the upper spray arm 41 and the lower spray arm 42.

In a bottom surface of the upper housing 410, there are an upper end receiving portion 414 for placing a portion of an upper end of the impeller 220, an upper washing water flow passage 415 for guiding the washing water pumped by the impeller 220, and an outlet 416 for guiding the washing water pumped from the upper washing water flow passage 415 to an upper outside of the upper housing 100. The outlet 416 is in communication with the sampling flow passage 411 and the main flow passages 412, and 413.

The upper washing water flow passage 415 surrounds the upper end receiving portion 414, and the outlet 416 is formed at an end of the upper washing water flow passage 415.

Along with this, in the upper surface of the upper housing 410, there is a valve receiving portion 417 in communication with the outlet 416, additionally.

The main flow passages 412, and 413 are the first main flow passage 412 for guiding the washing water to the lower spray arm 42, and a second main flow passage 413 for guiding the washing water to the upper spray arm 41. The first main flow passage 412 extends from the valve receiving portion 417 to a center of the upper housing 410, and the second main flow passage 413 extends from the valve receiving portion 417 to an edge of the upper housing 410. At a portion of the sump cover 500 positioned at an end of the first main flow passage 412, there is a first connection portion 501 for connection with the second connection pipe 65, and at a portion of the sump cover 500 positioned at the end of the second main flow passage 413, there is a second connection portion 502 for connection with the first connection pipe 61.

The valve receiving portion 417 is formed at a portion where the main flow passages 412, and 413 and the sampling flow passage 411 meet.

The valve receiving portion 417 has a diverting valve 430 mounted thereon for guiding a portion of the washing water from the outlet 416 to the first main flow passage 412, or the second main flow passage 413, selectively, or at the same time.

The diverting valve 430 has a rib 431 which is always in communication with the outlet 416, and the sampling flow passage 411 basically, and can block the first main flow passage 412, and the second main flow passage 413 selectively, or at the same time.

Referring to FIG. 2, the diverting valve 430 has a bottom on the sump housing 100, to position the diverting valve 430 at the valve receiving portion 417 when the guide assembly 400 is mounted on the sump housing 100. For this, the lower housing 420 has a mounting hole 422 in conformity with the valve receiving portion and the diverting valve 430 passes therethrough. Under the sump housing 100, there is an operating mechanism 432 under the sump housing 100 for operating the diverting valve 430. As shown in FIG. 2, the operating mechanism 432 includes a step motor for accurate control of at least a rotation angle of the diverting valve 430.

The lower housing 420 is joined to a bottom of the upper housing 410, and at an upper surface of the lower housing 420, there are an impeller loading portion 440 and the soil chamber 421 formed therein.

The impeller loading portion 440 surrounds the impeller 220, for guiding the washing water flowed by the impeller 220. The impeller loading portion 440 is formed at a center of the upper surface of the lower housing 420, and the soil chamber 421 is formed in a periphery of the upper surface of the lower housing 420. The soil chamber 421 is separated from the impeller loading portion 440.

The soil chamber 421 has an opened upper side, and the impeller loading portion 440 is closed by the upper housing 410.

The impeller loading portion 440 surrounds the impeller 220, for guiding the washing water flowed by the impeller 220. It is preferable that the impeller loading portion 440 is formed as one body with the lower housing 420 rather than formed as an independent body.

At an upper surface of the impeller loading portion 440, there are an inlet 441 for introduction of water from the recess 110, a lower end receiving portion 442 for receiving a portion of a lower end of the impeller 220, and a lower washing water flow passage 443 in correspondence to the upper washing water flow passage 415 for guiding the washing water pumped by the impeller 220.

The lower end receiving portion 442 surrounds the inlet 441, and the inlet 441 is in communication with an inlet 224 to the impeller 220 placed on the lower end receiving portion 442. The lower washing water flow passage 443 surrounds the lower end receiving portion 442.

In the meantime, a connection structure between the drain chamber 300 and the soil chamber 421 and a connection structure between the sampling flow passage 411 and the drain chamber 300 will be described in more detail.

Referring to FIG. 2, the lower housing has a connection pipe 451 at a portion opposite to the drain chamber 300 for connecting between the soil chamber 421 and the drain chamber 300, and a lower end of the connection pipe 451 is connected to the drain chamber 300. FIG. 3 illustrates a state the upper housing 410 and the lower housing 420 are mounted on the sump housing 100, and FIG. 4 illustrates a connection structure between the connection pipe 451 and the drain chamber 300 in detail.

Referring to FIG. 2, on an outlet side of the sampling flow passage 411 of the upper housing 410, there is a first drain portion 452 projected downward. The upper housing 420 has a second drain portion 453 projected toward the connection pipe 451 in correspondence to the first drain portion 452.

Referring to FIGS. 3 and 4, the second drain portion 453 is in communication with a portion of an upper end of the connection pipe 451, and rest portion of the upper end of the connection pipe 451 is in communication with the soil chamber 421.

Therefore, the washing water provided through the sampling flow passage 411 passes through the first drain portion 452, the second drain portion 453, and the connection pipe 451 in succession, and is provided to the drain chamber 300, and therefrom to the soil chamber 421 through the connection pipe 451 again.

The structures of the drain portions 452, and 453 and the connection pipe 451 are applicable not only to a structure as shown in FIG. 5 in which the sump housing 100 and the soil chamber 421 are separated, but also to a structure as shown in FIG. 6 in which the soil chamber 421 is formed in the sump housing 100.

Next, the sump cover 500 of the sump assembly will be described.

The sump cover 500 filters the washing water overflowed from the soil chamber 421.

Referring to FIG. 2, the sump cover 500 covers an upper surface of the sump housing 100, and forms a bottom of the tub 200 of the dishwasher.

The sump cover 500 has a plurality of pass through holes 510 formed in an inner side, and a plurality of recovery holes 520 formed in a periphery side. The pass through holes 510 have filtering members 530 provided thereto, respectively.

The pass through holes 510 are in communication with the soil chamber 421, and the recovery holes 520 are in communication with an inside of the sump housing 100. As described, the inside of the sump housing 100 and the inside of the soil chamber 421 are separated.

In the meantime, an unexplained symbol 113 denotes heater, for selective heating of the washing water.

The operation of the dishwasher in accordance with a first preferred embodiment of the present invention will be described.

When a control for washing or rinsing of the dishes takes place, the washing water is supplied to the recess 110 through the water supply hole 111 in the sump housing 100 connected to the water supply pipe 70. In this instance, the washing water is heated by the heater 113 as required.

Upon completion of the water supply, the washing motor 210 is operated to rotate the impeller 220, to pump the washing water from the recess 110 to the outlet 416 in the upper housing 410. That is, the washing water is pumped in an axial direction of the impeller 220, and discharged in a radial direction of the impeller 220, to flow along the lower washing water flow passage to the outlet 416. In this instance, the washing water is smashed by the disposer 230 secured to the shaft 211 of the washing motor 210 during the washing water is pumped.

Then, the washing water is introduced to the valve receiving portion 417 in communication with the outlet 416, and a portion of which is provided to the sampling flow passage 411 and rest of which is provided to the main flow passages 412, and 413.

In this instance, the diverting valve 430 in the valve receiving portion 417 is operated such that the washing water is guided to at least one of the main flow passages 412, and 413.

For an example, if the washing water is supplied only to the lower spray arm 42, the rib 431 of the diverting valve 430 is operated to close the second main flow passage 413, and if the washing water is supplied only to the upper spray arm 41, the rib 431 of the diverting valve 430 is operated to close the first main flow passage 412, and, as shown in FIG. 7, if the washing water is supplied both to the upper spray arm 41 and the lower spray arm 42, the rib 431 of the diverting valve 430 is operated to open both of the main flow passages 412, and 413.

Accordingly, the washing water supplied to the upper spray arm 41 and/or the lower spray arm 42 is sprayed to the upper rack 31 and/or the lower rack 32 in the tub 20, to washing the dishes on the upper rack 31 and/or the lower rack 32.

In the meantime, of the washing water pumped, a portion provided to the sampling flow passage 411 passes the first drain portion 452, the second drain portion 453, and the connection pipe 451 in succession, and is provided to the drain chamber 300, and, then, the washing water passes the drain chamber 300, and is provided the soil chamber 421 through the connection pipe 451, again.

In this instance, of the foreign matter in the washing water, particles having a relatively high density, or heavy are held in the drain chamber 300, and particles having a relatively low density, or light are provided to the soil chamber 421, together with the washing water.

The washing water provided to the soil chamber 421 passes through the pass through holes 510 in the sump cover 500, and overflows to an inside of the tub 20 as a water level in the soil chamber 421 rises gradually.

In this instance, foreign matters in the washing water is filtered by the filter members 530 on the pass through holes 510 in a process the washing water passes through the pass through holes 510, and the foreign matter is remained in the soil chamber 421.

Accordingly, only pure washing water overflows to the inside of the tub 20, and introduced to an inside of the sump housing 100 through the recovery holes 520 formed in the periphery of the sump cover 500 together with the washing water which washed the dishes and the foreign matter removed from the dishes, and therefrom to the recess 110, again.

Thereafter, as above series of steps are repeated, the foreign matter in the washing water is accumulated in the soil chamber 421, continuously.

As described, after the washing water passes the sampling flow passage 411, a fixed portion of the washing water pumped is cleaned step by step at the drain chamber 300, the soil chamber 421, and the filter members 530, and is returned to the sump housing 100, again.

In this instance, though it appears that only a small amount of the washing water is filtered at the drain chamber 300, the soil chamber 421, and the filter members 530, since the washing water is filtered continuously throughout the washing or rinsing, a good washing water filtering performance can be provided.

In the meantime, in a case the washing or rinsing is finished, or the washing water is contaminated heavily, the drain pump 600 is operated.

In this case, the washing water and soil is discharged from the soil chamber 421, the drain chamber 300, and the recess 110 in the sump housing 100 to an outside of the dishwasher through the drain hose 80 by the drain pump 600.

In the meantime, FIGS. 8 to 11 each illustrates a sump assembly in a dishwasher in accordance with a second preferred embodiment of the present invention.

Referring to FIGS. 8 and 9, the sump assembly in a dishwasher in accordance with a second preferred embodiment of the present invention is provided with a modified structure of a sump cover 500.

The modification of the sump cover 500 lies on improvement of recovery efficiency of the washing water, and prevention of deformation of the filter members 530 in separation of the foreign matter, which will be described in more detail, with reference to the attached drawings.

Referring to FIG. 9, the sump cover 500 in a dishwasher in accordance with the second preferred embodiment of the present invention is sloped downwardly as it goes from a substantially central portion to a circumference the more.

That is, the sump cover 500 is sloped downward as it goes from a portion the pass through holes 510 are formed therein to a portion the recovery holes 520 are formed therein the more.

Such a series of structure is for smoother recovery of the washing water overflowed through the soil chamber 421 to the sump housing 100.

Moreover, it is preferable that a leakage preventive portion 540 is further provided on an underside of the sump cover 500 for separating the portion the recovery holes 520 are formed therein, and the portion the pass through holes are formed therein.

A structure of the leakage preventive portion 540 will be described with reference to FIG. 5.

The leakage preventive portion 540 includes a first leakage preventive rib 541 which is a rim on the upper housing 410, and a second leakage preventive rib 542 which is a rim on the lower housing 420.

The first leakage preventive rib 541 is in close contact with a sidewall of the upper housing 410, for preventing the washing water flowing along the main flow passages 412, and 413 and the sampling flow passage 411 from leaking.

The second leakage preventive rib 542 prevents the washing water flowing along the upper washing water flow passage 415, the lower washing water flow passage 443, and the soil chamber 421 from leaking.

For this, the leakage preventive ribs 541, and 542 are projected from the underside of the sump cover 500 to predetermined heights, respectively. As shown in FIG. 11, if the upper housing 410 is joined with the sump cover 500, the first leakage preventive rib 541 surrounds a sidewall of the upper housing 410, to separate an inside of the upper housing 410. Though not shown, the second leakage preventive rib 542 also surrounds a sidewall of the lower housing 420, to separate the soil chamber 421 in the lower housing 420.

Embodiments of the filter members 530 in a structure of the sump cover 500 in accordance with a second preferred embodiment of the present invention will be described with reference to FIGS. 8 to 11.

The filter member 530 includes a first filter 531 and a second filter 532. It is preferable that the second filter 532 has eyes of mesh greater than the same of the first filter 531.

If only the first filter 531 having relatively small eyes of mesh is mounted on the sump cover 500, it is liable that a relatively high water pressure is applied to the first filter 531, to deform the filter member 530, and if only the second filter 532 having relatively large eyes of mesh is mounted on the sump cover 500, it is liable that a problem will be caused in which fine particles of the foreign matter can not be filtered.

Accordingly, it is preferable that the first filters 531 having small eyes of mesh are mounted on some of the pass through holes 510, and the second filters 532 having large eyes of mesh are mounted on rest of the pass through holes 510.

The first filter 531 and the second filter 532 may, or may not be formed as one body.

In addition to this, it is preferable that a supporting portion 550 is provided to a portion of the sump cover where the pass through hole 510 is formed for supporting the filter member 530.

The filter supporting portion 550 prevents sagging or deformation of the filters 531, and 532 by a water pressure applied thereto coming from circulation of the washing water.

For this, it is preferable that the filter supporting portion 550 supports at least one side of an upper side, and a lower side of the filter member 530.

Referring to FIG. 12, an embodiment of the filter supporting member 550 includes at least one upper supporting rib 551 for supporting an upper surface of the filter member 530.

It is desirable that a number of the upper supporting rib 551 is determined according to an area of the filter member 530, appropriately.

Next, referring to FIG. 13, another embodiment of the filter supporting member 550 includes at least one lower supporting rib 552 for supporting a lower surface of the filter member 530.

It is desirable that a number of the lower supporting rib 552 is determined according to an area of the filter member 530, appropriately.

However, if only the upper surface of the filter member 530 is supported, it is liable that the filter member 530 sags downward or damaged by the washing water sprayed from the upper spray arm 41 and the lower spray arm 42 and fell down to hit the filter member 530.

Moreover, if only the lower surface of the filter member 530 is supported, it is liable that the filter member 530 is deformed upwardly by a water pressure of the washing water discharged from the soil chamber 421.

Therefore, as shown in FIG. 14, it is preferable that the filter supporting portion 550 in accordance with another preferred embodiment of the present invention includes at least one lower supporting rib 552, and at least one upper supporting rib 551. The lower supporting rib 552 supports an underside of the filter member 530, and the upper supporting rib 551 supports the upper surface of the filter member 530.

The lower supporting ribs 552 and the upper supporting ribs 551 may be arranged opposite to each other, or alternately.

In the embodiments, if the filter supporting portion 550 includes a plurality of supporting ribs 551, and 552, it is preferable that the plurality of supporting ribs 551, and 552 are arranged at regular intervals.

At the end, a structure of the filter supporting portion 550 in accordance with a second preferred embodiment of the present invention prevents sagging, or deformation of the filter members 530 on the pass through holes 510 by a water pressure during washing.

Moreover, the sloped sump cover 500 in accordance with a second preferred embodiment of the present invention enables smooth recovery of the washing water overflowed from the soil chamber 421 to the recess 110 in the sump housing 100 through the recovery holes 520.

In the meantime, FIGS. 15 to 17 attached hereto each illustrates a sump assembly in a dishwasher in accordance with a third preferred embodiment of the present invention.

Referring to FIG. 15, the dishwasher in accordance with a third preferred embodiment of the present invention is provided with a series of structures which enable primary filtering of foreign matter before the washing water flows along flow passages in the sump assembly, which will be described in more detail with reference to the attached drawings.

The sump assembly in a dishwasher in accordance with a third preferred embodiment of the present invention includes a screen 700, additionally.

Referring to FIG. 16 attached hereto, the screen 700 filters foreign matters from the washing water being introduced to the lower housing 420 from the recess 110 in the sump housing 100, primarily.

The screen 700 is a plate having a pass through hole 710 for pass through of the shaft 211 of the washing motor 210, and a plurality of holes for pass through of the washing water.

It is preferable that the screen 700 is fastened to a bottom of the recess 110 in the sump housing 100 with hooks 114, for securing the screen 700 so that the screen 700 can filter the foreign matter from the washing water smoothly without being shaken by circulation of the washing water.

At least one hook 114 is formed. It is preferable that the hooks 114 are arranged symmetrically.

It is preferable that the screen 700 is formed of stainless steel or alloy steel, for minimizing breakage of the screen 700 by the water pressure of the washing water. Of course, the screen 700 may be formed of plastic having a predetermined strength.

FIG. 17 attached hereto is a diagram for explaining a relation between the screen 700 and the disposer 230.

That is, the screen 700 is mounted on a shaft 211 of the washing motor 210. It is preferable that the disposer 230 coupled to the washing motor 210 with a shaft is positioned under the screen 700. Of course, the disposer 230 may be positioned over the screen 700.

The disposer 230 has a diamond shape. Of course, the disposer 230 may have other polygonal shape, or a blade of a wing, or tooth shape.

It is preferable that the disposer 230 has a width L2 greater than a diameter L1 of the pass through hole 710 in the screen 700 for preventing the foreign matter from passing through the pass through hole 710 directly to the lower housing 420 without being filtered at the screen 700.

Of course, as shown in FIG. 18 attached hereto, the width L3 of the disposer 230 may be formed smaller than the diameter L1 of the pass through hole 710.

In conclusion, the series of structures in accordance with the third preferred embodiment of the present invention enable the foreign matter smashed by the disposer 230 and filtered by the screen 700 primarily during the washing water is pumped.

According to this, foreign matter is minimized in the washing water provided to the spray arms 41, and 42 through the main flow passages 412, and 413.

Moreover, even if the washing water is provided to the soil chamber 421 via the drain chamber 300 along the sampling flow passage 411, and overflowed through the pass through holes 510 in the sump cover 500, cases in which the filter member 530 on each of the pass through holes 510 is blocked are minimized, to reduce a pressure on the filter member 530.

In the meantime, FIGS. 19 to 21 attached hereto each illustrates an inside structure of a drain chamber 300 in a sump assembly of a dishwasher in accordance with a fourth preferred embodiment of the present invention.

Referring to FIGS. 19 to 21, the sump assembly of a dishwasher in accordance with a fourth preferred embodiment of the present invention is provided with a modified inside structure of the drain chamber 300.

The inside structure of a drain chamber 300 enables to hold the foreign matter in the drain chamber 300, primarily, which will be described in more detail.

Referring to FIG. 19 attached hereto, the drain chamber 300 in accordance with a fourth preferred embodiment of the present invention includes a housing 310 which forms a predetermined inside space.

The housing 310 has a first drain hole 311 and a second drain hole 312. The first drain hole 311 is in communication with the recess 110 in the sump housing 100, and the second drain hole 312 is in communication with the drain pump 600.

The housing 310 has an opened top, through which the housing 310 is in communication with the guide assembly 400.

In more detail, referring to FIGS. 20 and 21 attached hereto, for making the guide assembly 400 and the drain chamber 300 in communication, the first drain portion 452, the second drain portion 453, and the connection pipe 451 are connected to an upper portion of the housing 310, which is described in the first preferred embodiment of the present invention, already. In the drain chamber 300, there is a rib 330 for secure joining of the first drain portion 452, and the second drain portion 453, with the connection pipe 451.

In the meantime, the drain chamber 300 includes a valve portion 320 for making the drain chamber 300 which is in communication with the guide assembly 400 in communication with the recess 110 in the sump housing 100, selectively.

The valve portion 320 opens, or closes the first drain hole 311 in communication with the recess 110, selectively. In this instance, the valve portion 320 is operated to make the drain chamber 300 in communication with the recess 110 in the sump housing 100 owing to a pressure of the washing water circulating in the drain chamber 300, or separate the drain chamber 300 from the recess 110.

For this, it is preferable that the valve portion 320 is a check valve which allows only one direction flow. That is, only when the washing water starts to flow from the recess 110 to the drain chamber 300, the valve portion 320 opens the first drain hole 311 by the pressure of the washing water.

In the embodiment of the present invention, the valve portion 320 includes a valve body 321 for opening/closing the first drain hole 311, and a fastening portion 322 for fastening the valve body 321 to the drain chamber 300. As shown in FIG. 19, the fastening portion 322 is inserted in a recess 331 in the rib 330 for secure holding of the fastening portion 322.

In this instance, it is preferable that the valve body 321 has a projection 323 for inserting in and fitting to the first drain hole 311, additionally.

Particularly, the valve portion 320 may be formed of an elastic material, when the valve portion is deformed elastically by the pressure of the washing water to open the first drain hole 311.

Moreover, the fastening portion 322 may have a hinge, when the valve portion 320 swings around the fastening portion 322 to open the first drain hole 311.

The operation of the valve portion 320 in accordance with a fourth preferred embodiment of the present invention will be described with reference to FIGS. 20 and 21 attached hereto.

At the time of draining the washing water, the drain pump 600 is operated, to make the washing water to flow from the drain chamber 300 in a direction the drain pump 600 is mounted as shown in FIG. 21.

Along with this, the valve portion 320 in the drain chamber 300 moves to open the first drain hole 311 owing to suction force generated by the drain pump 600 and the pressure of the washing water starting to flow from the recess 110 to the drain chamber 300.

According to this, the drain chamber 300 becomes in communication, not only with the guide assembly 400, but also with the recess 110 during the washing water is draining.

At the end, the drain pump 600 can drain the washing water from the guide assembly 400 and the recess 110 to an outside of the dishwasher through the drain chamber 300. FIG. 22 attached hereto illustrates a diagram provided for better understanding of a process of draining of the foreign matter from the soil chamber 421 in the guide assembly 400 through the drain chamber 300.

In this instance, the washing water pumped by the drain pump 600 is drained to the drain hose 80 through the nipple 640 of the drain pump 600.

In the meantime, referring to FIG. 20 attached hereto, while the dishes are washed, the washing water flows into the drain chamber 300 continuously from the guide assembly 400 passing through the first drain portion 452, the second drain portion 453, and the connection pipe 451 in succession.

In this instance, the valve portion 320 in the drain chamber 300 maintains a closing state of the first drain hole 311 owing to the pressure of the washing water introduced thereto, to separate the drain chamber 300 from the recess 110.

According to this, the drain chamber 300 forms an independent flow passage only in communication with the guide assembly 400 during washing the dishes. Such an independent flow passage leads the washing water to flow to the soil chamber 421 of the guide assembly 400 through the drain chamber 300. That is, the washing water neither drains to an outside of the dishwasher through the drain hose 80, nor flows into the recess 110.

In this instance, the drain chamber 300 is positioned under the guide assembly 400. Accordingly, the washing water flows downwardly toward the drain chamber 300 from the guide assembly 400 through the first drain portion 452, the second drain portion 453, and the connection pipe 451. Then, after the washing water flows upwardly through the portion 451*a* of the connection pipe 451 in communication with the soil chamber 421, the washing water flows to the soil chamber 421.

During the washing water flows toward the soil chamber 421 via the drain chamber 300, foreign matter deposit from the washing water to a bottom of the drain chamber 300 by gravity. Particularly, relatively heavy particles (high density) of the foreign matter deposits in the drain chamber 300, while light particles of the foreign matter flows to the soil chamber 421.

In this instance, as described in the first embodiment, the foreign matter flowed to the soil chamber 421 is held in the soil chamber 421.

At the end, since the drain chamber 300 removes the foreign matter primarily, for the soil chamber 300 to receive relatively low density particles of the foreign matter, the clogging of the filter member 530 on the pass through holes 510 of the sump cover is minimized.

In the meantime, alike the embodiments described before, there can be a variety of embodiments of the dishwasher of the present invention.

That is, all features of the series of structures suggested in all the embodiments of the present invention may be applied to the dishwasher of the present invention, or features of the series of structures suggested in any one of the embodiments may be applied to the dishwasher of the present invention. It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

As has been described, the present invention improves a structure of a dishwasher to make efficient recycling of the washing water, the present invention has a good industrial applicability.

The invention claimed is:

1. A dishwasher comprising:

a sump housing for holding washing water;

a washing water pumping unit for pumping the washing water;

a drain chamber for receiving the washing water pumped by the washing water pumping unit and for depositing particles contained in the washing water by gravity of the particles;

a soil chamber, positioned above the drain chamber, for receiving the washing water after the washing water has passed through the drain chamber;

a guide assembly for guiding the washing water pumped by the washing water pumping unit to be provided to the soil chamber via the drain chamber; and a sump cover covered on an upper surface of the sump housing for filtering the washing water overflowed from the soil chamber;

wherein the guide assembly includes:

a sampling flow passage for guiding a portion of the pumped washing water to the drain chamber, and a plurality of main flow passages for guiding the washing water not provided to the sampling flow passage to at least one spray arm.

2. The dishwasher as claimed in claim 1, wherein the drain chamber is formed on one side of the sump housing's down portion.

3. The dishwasher as claimed in claim 2, wherein the drain chamber is connected to an inlet of a drain pump for draining the washing water.

4. The dishwasher as claimed in claim 1, wherein the guide assembly includes;

an upper housing on an upper side of the sump housing, the upper housing having a sampling flow passage for guiding a portion of the pumped washing water to the drain chamber, and a plurality of main flow passages for guiding the washing water not provided to the sampling flow passage to at least one spray arm; and a lower housing under the upper housing, the lower housing having the soil chamber and the impeller loading portion formed therein.

5. The dishwasher as claimed in claim 4, wherein the guide assembly further includes;

a connection pipe connected between the soil chamber and the drain chamber, a first drain portion extended downward from an outlet side of the sampling flow passage in the upper housing, and a second drain portion extended from the lower housing toward the connection pipe opposite to the first drain portion.

6. The dishwasher as claimed in claim 4, further comprising a diverting valve at a portion the main flow passages and the sampling flow passage join for selective opening/closing of some of the main flow passages.

7. The dishwasher as claimed in claim 1, wherein the sump cover includes;

a plurality of pass through holes at a portion opposite to a position of the soil chamber on an inner side of the sump cover, each of the pass through holes being provided with a filter member, and a plurality of recovery holes in a periphery of the sump cover.

8. The dishwasher as claimed in claim 7, wherein the recovery holes are in communication with an inside of the sump housing, and the pass through holes are in communication with the soil chamber, and the inside of the sump housing and an inside of the soil chamber are separated from each other.

9. The dishwasher as claimed in claim 7, wherein the sump cover is sloped downward as it goes toward a periphery the more.

10. The dishwasher as claimed in claim 7, wherein the filter member includes;

a first filter and a second filter each having a plurality of eyes of mesh, wherein the second filter has eyes of mesh greater than the same of the first filter.

11. The dishwasher as claimed in claim 10, wherein the first filter and the second filter are formed as one body.

12. The dishwasher as claimed in claim 7, wherein the sump cover further includes a filter supporting portion on an inner side for supporting at least one of the upper side and the lower side of the filter member.

13. The dishwasher as claimed in claim 12, wherein the filter supporting portion includes a plurality of supporting ribs arranged at regular intervals for supporting the filter member.

14. The dishwasher as claimed in claim 12, wherein the filter supporting portion includes;

at least one lower supporting portion for supporting an underside of the filter member, and at least one upper supporting portion for supporting an upper side of the filter member.

15. The dishwasher as claimed in claim 14, wherein the upper supporting portion and the lower supporting portion are arranged opposite to each other.

16. The dishwasher as claimed in claim 7, wherein the sump cover further includes a leakage preventive portion for separating a portion the recovery hole are formed therein and a portion the pass through holes are formed therein.

17. The dishwasher as claimed in claim 1, wherein the guide assembly includes an upper housing, and a lower housing under the upper housing, the lower housing having the soil chamber and an impeller loading portion formed therein, and the washing water pumping unit includes a washing motor mounted to an underside of the sump housing, and an impeller coupled to the washing motor with a shaft and placed in the impeller loading portion.

18. The dishwasher as claimed in claim 17, further comprising a screen on the shaft of the washing motor for filtering foreign matter from the washing water flowing toward the lower housing.

19. The dishwasher as claimed in claim 18, wherein the screen includes;

a plate having a pass through hole for pass through of the shaft of the washing motor, and a plurality of holes for pass through of the washing water.

20. The dishwasher as claimed in claim 18, wherein the screen is fastened to a bottom of the sump housing with hooks.

21. The dishwasher as claimed in claim 18, further comprising a disposer on the shaft of the washing motor for smashing the foreign matter in the washing water flowing toward the lower housing.

22. The dishwasher as claimed in claim 21, wherein the disposer has a polygonal shape.

23. The dishwasher as claimed in claim 1, wherein the drain chamber has a drain hole in communication with the sump housing, the drain hole being provided with a valve portion for selective opening of the drain hole.

24. The dishwasher as claimed in claim 23, wherein the valve portion makes the drain chamber to be in communication with the sump housing, or the drain chamber to separate from the sump housing owing to a pressure of the washing water flowing through the drain chamber.

25. The dishwasher as claimed in claim 23, wherein the valve portion includes a check valve.

26. The dishwasher as claimed in claim 23, wherein the valve portion includes;

a valve body for opening/closing the drain hole; and a fastening portion for fastening the valve body to the drain chamber.

27. The dishwasher as claimed in claim 26, wherein the valve body includes a projection for inserting in, and fitting to the drain hole.

28. The dishwasher as claimed in claim 23, wherein the valve portion is formed of an elastic material.

29. The dishwasher as claimed in claim 1, wherein the soil chamber has a bottom surface sloped downward toward a portion in communication with the drain chamber.

30. A dishwasher comprising:

a sump housing for holding washing water;

a washing water pumping unit for pumping the washing water;

a drain chamber for receiving the washing water pumped by the washing water pumping unit and for depositing particles contained in the washing water by gravity of the particles;

a sampling flow passage for guiding a portion of the pumped washing water to the drain chamber, a plurality of main flow passages for guiding the washing water not provided to the sampling flow passage to at least one spray arm;

a soil chamber above the drain chamber for receiving the washing water after the washing water has passed through the drain chamber; and a sump cover covered on the soil chamber for filtering the washing water overflowed from the soil chamber.

* * * * *